US006701938B2

(12) United States Patent
Faragi

(10) Patent No.: US 6,701,938 B2
(45) Date of Patent: Mar. 9, 2004

(54) LIP CONTOUR KIT FOR APPLYING LIP LINER OR LIPSTICK

(76) Inventor: Janet Faragi, 9727 Sun Pointe Dr., Boynton Beach, FL (US) 33437

( * ) Notice: Subject to any disclaimer, the term of this patent is extended or adjusted under 35 U.S.C. 154(b) by 51 days.

(21) Appl. No.: 09/910,381

(22) Filed: Jul. 20, 2001

(65) Prior Publication Data

US 2003/0015214 A1 Jan. 23, 2003

(51) Int. Cl.[7] ..... A45D 40/30; A45D 40/26
(52) U.S. Cl. ..... 132/320; 132/319
(58) Field of Search ..... 132/319, 285, 132/320, 3; 101/127, 114, 35, 41, 129; 2/452; 3/562, 563, 564, 565

(56) References Cited

U.S. PATENT DOCUMENTS 1,526,028 A * 2/1925 Volkman ..... 132/319
1,564,806 A * 12/1925 Wieder ..... 132/319
1,704,290 A * 3/1929 Kirk ..... 132/319
1,944,691 A * 1/1934 Libby ..... 132/319
2,117,061 A * 5/1938 Helehan ..... 132/319
2,527,726 A * 10/1950 Hendrix ..... 132/319
2,746,463 A * 5/1956 Stuart ..... 132/319
2,931,369 A * 4/1960 Badovinac ..... 132/319
5,178,169 A * 1/1993 Lamle ..... 132/319
6,240,842 B1 * 6/2001 Hailey ..... 101/127

* cited by examiner

*Primary Examiner*—John J. Wilson
*Assistant Examiner*—Robyn Kieu Doan

(57) ABSTRACT

A lip contour kit comprising at least one stencil for assisting in the application of lip liner and lipstick to an individual's lips. Each stencil is used to assist in the application of lip liner to the upper lip and/or to the lower lip. Unlike the traditional make-up stencils designed for application of eyebrow pencil and lipstick, each member of the complimentary stencils are flexible, independent of the other and can be used alone or in conjunction with any other stencil. The stencils can also be provided with color codes, letters, numbers or marks, or other indicia to assist the make-up artist/individual in distinguishing one contour from another. The stencils of this invention can be self-adjusted relative to the upper and lower lip, respectively, to permit emphasis of one facial feature over another.

6 Claims, 2 Drawing Sheets

LIP CONTOUR KIT FOR APPLYING LIP LINER OR LIPSTICK

BACKGROUND OF THE INVENTION

1. Field of the Invention

This invention relates to a device and to a method. More specifically, this invention relates to a lip stencil kit which includes a plurality of complimentary lip liner stencils. The lip liner stencils which are contained within the kit include a seperate stencil for each of the upper and lower lip to create different cosmetic appearances.

2. Description of the Prior Art

The application of make-up, particularly cosmetic eye make-up, lip liner, lipstick and lip gloss is an art form. More specifically, both the professional cosmetician, and lay person, have come to use these cosmetics to flatter, and alternatively, to emphasize or de-emphasize a facial feature. More specifically, the application of such cosmetics is traditionally associated with the projection or creation of mood or personality state. In order to assist in the application of such cosmetics, certain devices have been developed to aid in their application. The following is representative of the patent literature relating to such devices.

U.S. Pat. No. 2,931,369 (to Badovinac, issued Apr. 5, 1960) discloses an adjustable stencil for application of lipstick. In the Badovinac device, a pair of complimentary component parts, one for the upper lip and another for the lower lip, are pivotally secured together to permit their relative adjustment for an individual's lips. In the Badovinac device, each of the individual components have a defined curve, and the pivotal attachment permits their adjustment relative to one another. The stencil described by Badovinac also appears to be limited in regard to the relative shape of the top lip to the bottom lip. The assembled device is further provided with a built in guide to position the composite stencil relative to the center of the top lip to insure symmetrical application of the cosmetic lipstick.

Other patents relating to stencils, templates and the like for the application of cosmetics include, U.S. Pat. No. 3,557,805, issued to Hamada, which discloses a template to create a variety of different eyebrow shapes. Another eyebrow template is disclosed in U.S. Pat. No. 2,628,626, issued to Teillaud.

In each of the make-up application stencils and templates described in the prior art, the outline of the template and/or stencil has an essentially fixed contour or curve. Moreover, each of the prior art devices limit the amount/area (width) of the cosmetic application to the outline provided therein. Accordingly, the application of make-up is restricted to the specific combination of upper and lower lip contour that has been pre-set by the manufacturer. Moreover, such prior art devices do not allow for individual differences in the relative proportions or shapes of the lips, specifically, an individual's desire to emphasize of de-emphasize one feature relative to another. Thus, there continues to exist a need to provide a stencil set that permits an individual freedom in the selection of her lip contour preferences, including the ability to change the shape and size of her lips so as to present her most flattering appearance.

OBJECTS OF THE INVENTION

It is the objects of this invention to remedy the above and related deficiencies in the prior art.

More specifically, it is the principle object of this invention to provide a lip contour kit having a plurality of stencils to assist in the application of lip liner and lipstick to an individual's upper and lower lips.

It is another object of this invention to provide a lip contour kit having a plurality of stencils, which can be used to emphasize or de-emphasize a facial feature, in the application of lip liner or lipstick to an individual's upper and lower lips.

It is yet another object of this invention to provide a lip contour kit having a plurality of stencils, which can be used to create an image, mood or persona, in the application of lip liner or lipstick to an individual's upper and lower lips.

Additional objects of this invention include the use of indicia or color codes on such stencils to assist in the coordination of different shapes to an individual's upper and lower lip preferences.

SUMMARY OF THE INVENTION

The above and related objects are achieved by providing a lip contour kit comprising complimentary stencils for assisting in the application of lip liner and lipstick to an individual lips. In the preferred embodiments of this invention, each stencil is used to assist in the application of lip liner or lipstick to the upper lip and/or to the lower lip. Unlike the traditional make-up stencils designed for application of eyebrow pencil and lip gloss, each stencil is flexible, independent of other stencils in the lip contour kit, and can be used alone or in conjunction with another stencil from a different stencil combination. In another of the preferred embodiments of this invention, the stencils are provided with color coordination indicia to assist the make-up artist/individual with color codes, letters, numbers or marks to depict the desired contours. In another of the preferred embodiments of this invention, the stencils of this invention can be adjusted because of their flexibility and the ability to mix and match one stencil with another, relative to an upper and a lower lip, respectively, to permit emphasis of one facial feature over another.

DETAILED DESCRIPTION OF THE INVENTION INCLUDING PREFERRED EMBODIMENTS

Figure 1A:
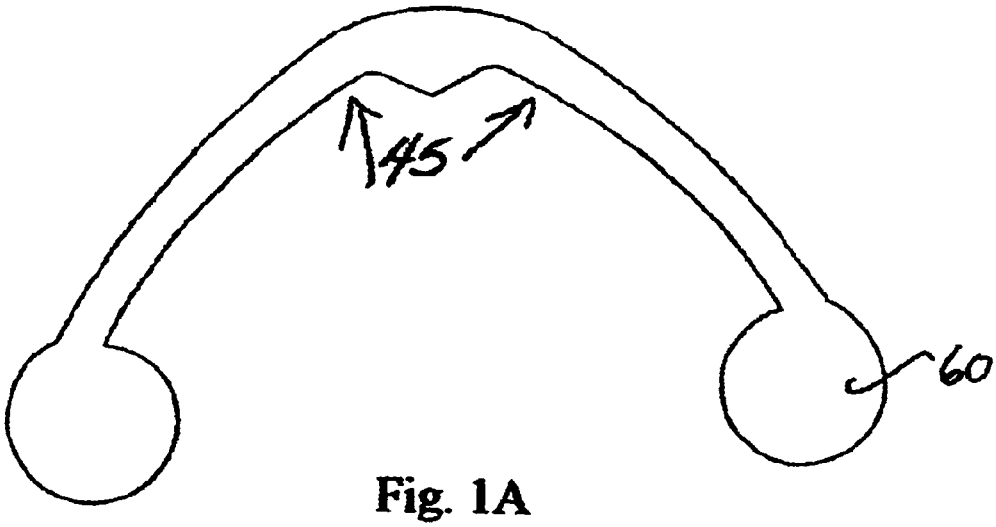
FIG. 1 depicts a series of stencils for use in the application of lip liner and/or lipstick to upper lips.

The lip liner application stencils of this invention are depicted in the Figures which accompany this application. Where an element is present in more than one of these Figures, its is assigned a common reference numeral for continuity of expression and ease of understanding.

Figure 1B:
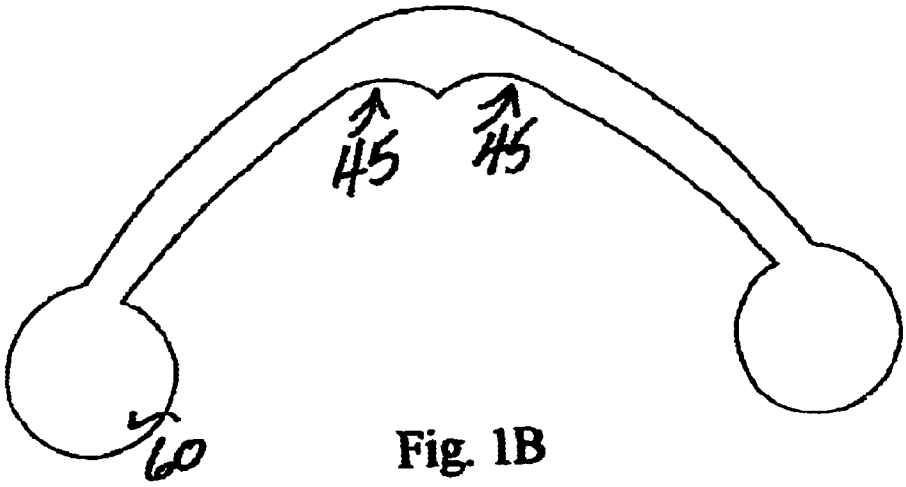
Figure 1C:
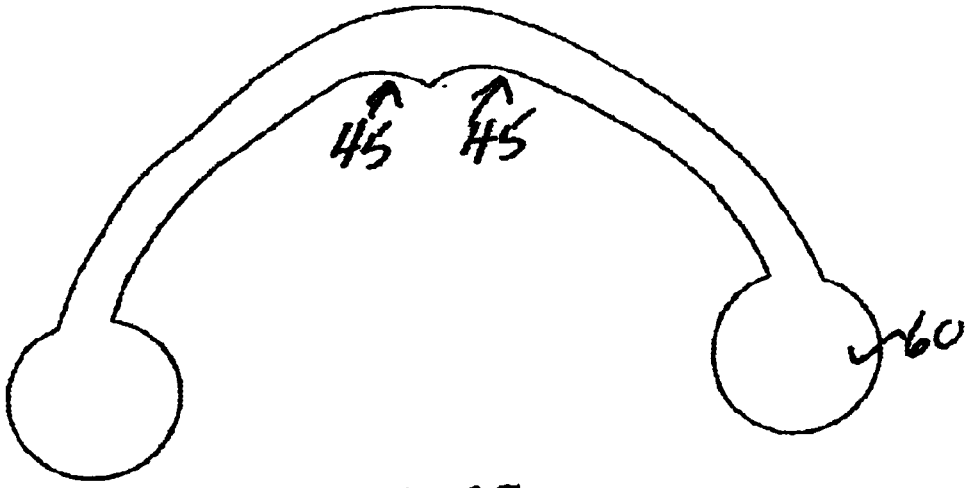

FIG. 1 depicts a series of stencils suitable for use in guiding the application of lip liner and/or lipstick to an upper lip. In the embodiments of the invention illustrated in FIG. 1, the stencils are arranged in order of various and decreasing curvature, specifically, the stencil depicted in FIG. 1A having the greatest curvature or arc (pout shape), the second stencil, illustrated in FIG. 1B, having an intermediate curvature or arc (heart shape) and lastly, the third stencil, illustrated in FIG. 1C, having relatively less curvature (round shape). Each stencil is characterized by its confining edge (45) and a pair of end tabs (60). The characterization of each upper lip stencil as "pout", "heart" and "round" is indicative of the stencil's confining edge (45), and the shape of the lip appearance upon application of lip liner and lipstick to such confining edge (45). In the pout stencil embodiment of this invention, the intended cosmetic appearance of the applied lip liner and lipstick approximates a "pouting" expression, whereas in the heart stencil embodiment of this invention, the indented cosmetic appearance of the applied lip liner and lipstick approximates a more amorous expression.

Figure 2A:
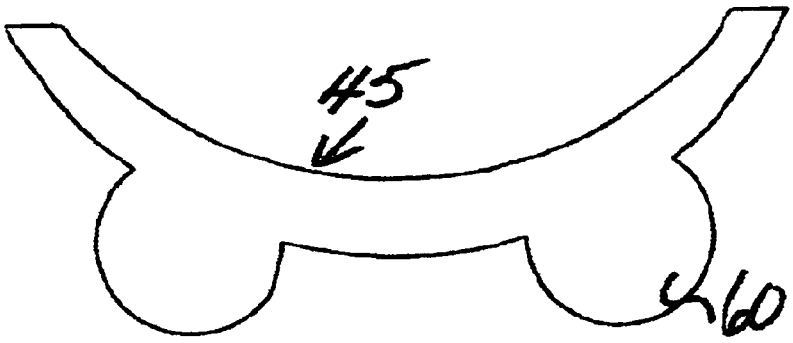
FIG. 2 depicts a series of stencils for use in the application of lip liner and/or lipstick to lower lips.
Figure 2B:
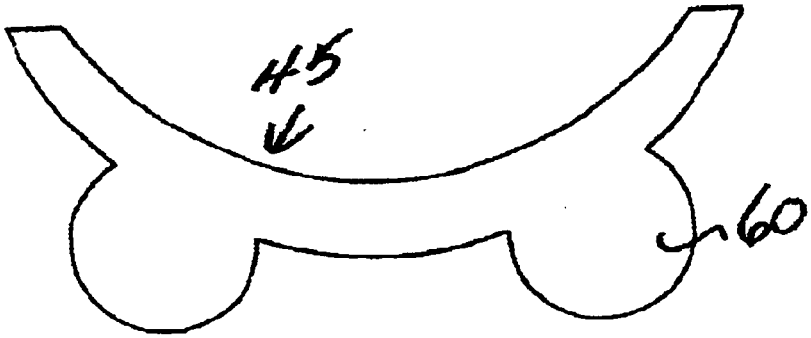
Figure 2C:
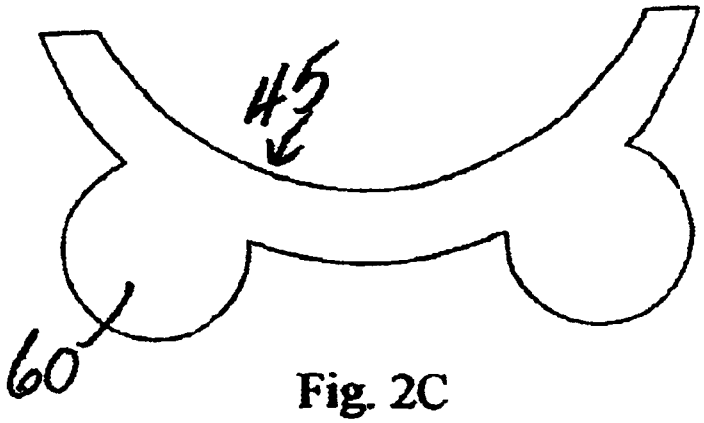

In each of the embodiments of the invention illustrated in FIG. 2, the lower lip stencils can match with an upper lip stencil of comparable curvature, or a lower lip stencil combined with an upper lip stencil having a greater or lesser curvature. In each instance, the objective would be to enable the individual the ability to enlarge, to reduce, or to perfect the shape and size of their lips to project a cosmetic appearance that would enhance the appearance of the individual, or project a different mood or expression.

Each of the upper and lower lip stencils of this invention can be combined with lip liner or lipstick in a given color or shade; or with a combination of lip liner or lipstick in a number of complimentary or contrasting colors or shades. In one of the preferred embodiments of this invention, the stencils of this invention can be pre-coded to suggest combinations of different colors of liner and/or lipstick to achieve certain cosmetic effects (e.g., emphasize or de-emphasize one lip in favor of another). In another of the embodiments of this invention, the stencils of this invention can be pre-coded to suggest stencil combinations to achieve similar cosmetic effects, or to project a mood, or persona of the individual.

The stencils of this invention are used individually to sequentially apply lip liner to either an upper or lower lip. In, for example, the application of lip liner to an upper lip, an individual could select from among the stencils illustrated in FIG. 1. Having made such selection, the flexible stencil is bent so that the confining edge (45) approximates the contour of the upper lip of the individual. The stencil can be moved up or down, depending upon the degree of fullness desired. Once the desired lip shape is approximated, the individual holds the stencil in place by pressing the fingers of one hand on the end tabs (60) of the stencil, while applying lip liner with the other hand to the upper lip using the confining edge (45) of the stencil as a guide. The lip liner is applied up against the confining edge (45) of the stencil to achieve a sharp and uniform cosmetic boundary as delimited by and corresponding to the stencil edge. Similarly, this process is repeated on the lower lip with a stencil selected from available choices illustrated in FIG. 2. The combination of upper and lower lip stencil is made independent of the one another, although the stencils themselves indicate the relative degree of curvature (e.g. slight, deep and deepest curve), and such indicia can be matched with the degree of curvature of the upper lip stencil, if desired.

The foregoing disclosure and description of the invention is illustrative and exemplary thereof, and various changes in size, shape and materials, as well as in the details of the illustrated construction, may be made within the scope of the appended claims without departing from the spirit of the invention.

What is claimed is:

1. A lip contour kit for applying lip liner comprising:

a first flexible stencil including a first confining edge adapted for outlining a first cosmetic boundary of an individual's lips, and a first region for maintaining said first stencil in a stationary position relative to the individual's ups with one hand without interfering with the first confining edge during application of lip liner, said first region located below a centerline of the individual's lips during application of lip liner with the first flexible stencil; and a second flexible stencil including a second confining edge adapted for outlining a second cosmetic boundary of an individual's lips, and a second region for maintaining said second stencil in a stationary position relative to the individual's lips with one hand without interfering with the second confining edge during application of lip liner, said second region located below a centerline of the individual's lips during application of lip liner with the second flexible stencil, wherein the first flexible stencil is configured to be translated approximately vertically before application of lip liner to permit a change of a shape of the first cosmetic boundary of an individual's lips and permits the first cosmetic boundary to be drawn in its entirety.

2. The lip contour kit of claim 1, wherein the first flexible stencil is adapted for outlining a cosmetic boundary on an individual's bottom lip and the second flexible stencil is adapted for outlining a cosmetic boundary on an individual's top lip.

3. The lip contour kit of claim 2, wherein the first and the second flexible stencils have graphic means or indicia associated therewith to permit a selection based an a desired cosmetic objective.

4. The lip contour kit of claim 3, wherein the graphic means or indicia approximately follows the confining edge of the first flexible stencil.

5. The lip contour kit of claim 1, wherein the first stencil is provided with indicia to distinguish one contour from another.

6. The lip contour kit of claim 1, wherein said kit includes cosmetics for use with the first and second stencils.

* * * * *